US007971391B2

(12) United States Patent
Harie

(10) Patent No.: US 7,971,391 B2
(45) Date of Patent: Jul. 5, 2011

(54) MOVABLE BODY DRIVING APPARATUS

(75) Inventor: Hiroshi Harie, Tokyo (JP)

(73) Assignee: Fuji Electric Systems Co., Ltd., Tokyo (JP)

( * ) Notice: Subject to any disclaimer, the term of this patent is extended or adjusted under 35 U.S.C. 154(b) by 503 days.

(21) Appl. No.: 11/607,883

(22) Filed: Dec. 4, 2006

(65) Prior Publication Data

US 2007/0251150 A1 Nov. 1, 2007

(30) Foreign Application Priority Data

Apr. 28, 2006 (JP) ..... 2006-124998

(51) Int. Cl.
*E05F 17/00* (2006.01)

(52) U.S. Cl. ..... 49/120; 49/118; 49/362

(58) Field of Classification Search ..... 49/118, 49/120, 362, 370; 310/68 B, 83
See application file for complete search history.

(56) References Cited

U.S. PATENT DOCUMENTS 1,063,328 A * 6/1913 Christopher ..... 160/118
1,494,948 A * 5/1924 Bujack ..... 49/98
1,917,415 A * 7/1933 Woodruff ..... 49/100
2,791,420 A * 5/1957 Provost ..... 49/118
2,957,211 A * 10/1960 Howard ..... 49/95
3,199,858 A * 8/1965 Koblensky ..... 49/118
4,782,255 A * 11/1988 Oosaka et al. ..... 310/68 R
4,973,894 A * 11/1990 Johansson ..... 318/280
5,483,769 A * 1/1996 Zweili ..... 49/118
5,644,869 A * 7/1997 Buchanan, Jr. ..... 49/362
5,659,160 A * 8/1997 Tracey ..... 187/316
5,831,358 A * 11/1998 Bobay ..... 310/58
6,075,304 A * 6/2000 Nakatsuka ..... 310/216.137
6,119,402 A * 9/2000 Wisner ..... 49/362
6,578,672 B1 * 6/2003 Miyoshi ..... 187/254
6,708,448 B2 * 3/2004 Zappa ..... 49/41
6,942,066 B1 * 9/2005 Miyoshi et al. ..... 187/254
7,064,505 B2 6/2006 Sato
2005/0102903 A1 5/2005 Takahashi

FOREIGN PATENT DOCUMENTS

JP 2000-142392 5/2000

* cited by examiner

*Primary Examiner* — Jerry Redman
(74) *Attorney, Agent, or Firm* — Manabu Kanesaka

(57) ABSTRACT

A door driving apparatus includes a rotary actuator, a rotary transmission member integrally fixed to an output shaft extending from the rotary actuator, and a pair of linear transmission members opposed to each other via the rotary transmission member. The linear transmission members are configured to be in mesh with the rotary transmission member and to move approximately parallel to each other in opposite directions.

6 Claims, 10 Drawing Sheets

MOVABLE BODY DRIVING APPARATUS

BACKGROUND OF THE INVENTION AND RELATED ART STATEMENT

The present invention relates to a movable body driving apparatus for opening and closing a vehicle door or the like automatically.

Among conventional movable body driving apparatus of the above type, a door driving apparatus which uses a linear motor is known. JP-A-2000-142392 (page 6, FIG. 1) discloses a door opening/closing apparatus which opens and closes right and left doors using a single linear motor. FIG. 8 shows the configuration of a door opening/closing apparatus that is similar to the above one. As shown in FIG. 8, a movable member 101*a* of a linear motor 101 is connected to a left door 111 via hanging metal fittings 113*a* and 113*b* and a door drive plate 115.

A top rack 117 is fixed to a right door 112 via hanging metal fittings 114*a* and 114*b* and a link metal fitting 116, and a bottom rack 119 is in mesh with the top rack 117 via a pinion 118. The bottom rack 119 is connected to a link rod 120, and the link road 120 is connected to the movable member 101*a* of the linear motor 101 via the above-mentioned door drive plate 115.

When the movable member 101*a* is moved rightward or leftward (as viewed in FIG. 8), as the linear motor 101 is driven, the left door 111 and the right door 112 are slid in opposite directions and are thereby opened or closed.

FIGS. 9 and 10 show a conventional example in which a left door 111 and a right door 112 are opened and closed being driven by two linear motors 101 and 101'. As shown in FIGS. 9 and 10, a movable member 101*a* of a linear motor 101 is connected to the left door 111 via a door hanging metal fitting 113 and a lock hole bracket 121. Likewise, a movable member 101*a'* of a linear motor 101' is connected to the right door 112 via a door hanging metal fitting 113' and a lock hole bracket 121'.

When the movable members 101*a* and 101*a'* are moved in the right-left direction (see FIG. 9) in opposite directions as the linear motors 101 and 101' are driven, the left door 111 and the right door 112 are opened or closed being guided by door rails 122 and 122' (see FIG. 10).

Each of the conventional techniques of FIGS. 8-10 employ a linear motor(s) as a drive source. However, because of their structure, using linear motors, the length of a motor case (cylinder case) is equal to a door stroke length (in general, 600-900 mm) plus the length of the movable member. Therefore, linear motors are heavier and occupy a larger area than rotary motors.

Therefore, when employed in a vehicular door opening/closing apparatus, one or more linear motors is an obstacle to a compact design. Furthermore, where a permanent magnet movable coil type linear motor, for example, is used, there is another problem that the apparatus as a whole is costly because of the use of a large rare earth permanent magnet.

The present invention solves the above problems. An object of the invention is therefore to provide a movable body driving apparatus which enables a compact design and can simplify adjustment work after its mounting.

Further objects and advantages of the invention will be apparent from the following description of the invention.

SUMMARY OF THE INVENTION

To attain the above object, the invention provides a movable body driving apparatus comprising a rotary actuator and a rotary transmission member which is fixed integrally to an output shaft that extends from the rotary actuator. In addition, a pair of linear transmission members is provided and oppose each other via the rotary transmission member so as to be in mesh with the rotary transmission member and move approximately parallel with each other in opposite directions.

The movable body driving apparatus may further comprise first and second bearing members which bear the output shaft, and the rotary transmission member may be disposed between the first and second bearing members.

The movable body driving apparatus may further comprise guide members for guiding the pair of linear transmission members.

The movable body driving apparatus may further comprise a holding case that holds the pair of linear transmission members and the guide members, the holding case being fixed integrally to a body frame of the rotary actuator.

The rotary actuator may comprise a sensor capable of detecting at least the number of rotations and a rotation direction of the output shaft.

According to the invention, since the rotary transmission member is fixed to the output shaft that projects from the rotary actuator, and the pair of linear transmission members is in mesh with the rotary transmission member, a compact design of a movable body driving apparatus is enabled in such a manner that it can be mounted even in a narrow space and adjustment performed after its mounting can be simplified.

DETAILED DESCRIPTION OF PREFERRED EMBODIMENTS

Embodiments of the present invention will be hereinafter described with reference to the drawings.

First Embodiment

Figure 1:
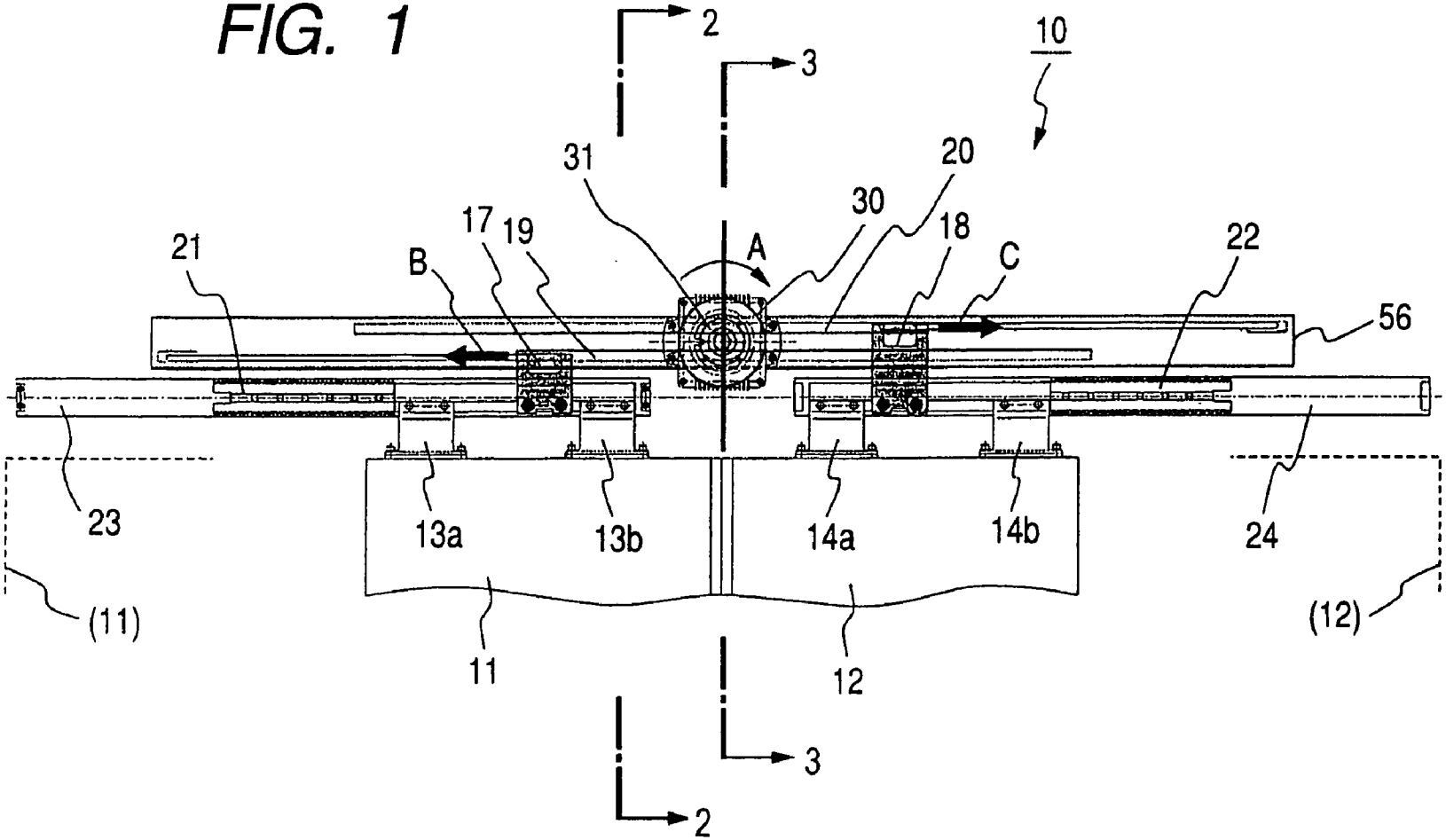
FIG. 1 is a front view of a door driving apparatus according to a first embodiment.
Figure 2:
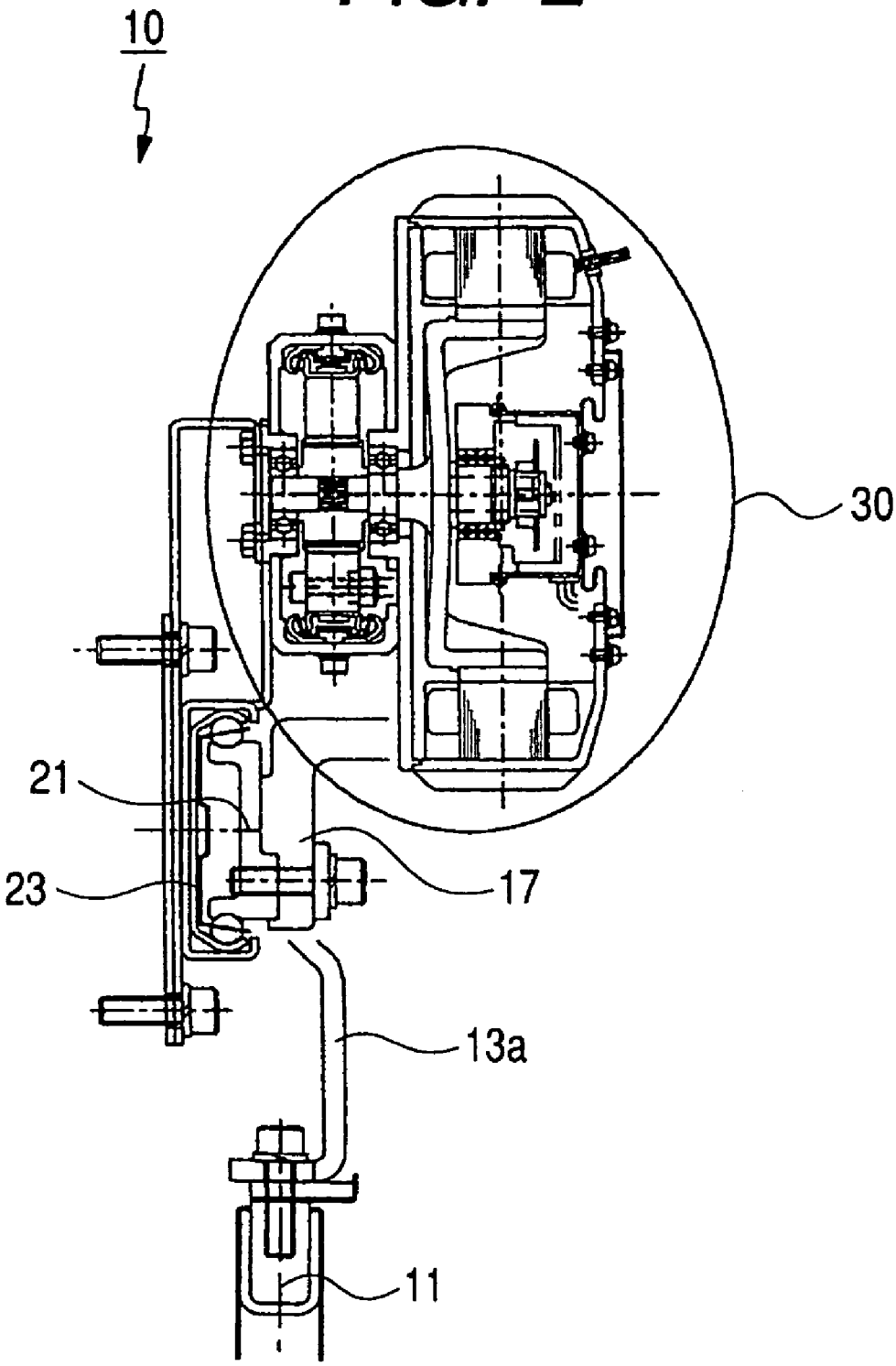
FIG. 2 is a sectional view taken along line 2-2 in FIG. 1.

FIG. 1 is a front view of the entire door driving apparatus according to a first embodiment of the invention. FIG. 2 is a sectional view taken along line 2-2 in FIG. 1.

As shown in FIGS. 1 and 2, the door driving apparatus 10 includes a pair of doors (i.e., a left door 11 and a right door 12) comprising movable bodies, and a motor 30 as a rotary actuator. Hanging metal fittings 13*a* and 13*b* are provided for hanging the left door 11. In addition, a left slider 21 that is fixed to the hanging metal fittings 13*a* and 13*b*, a link metal fitting 17 that is fixed to the left slider 21, and a left rack 19 operating as a linear transmission member that is fixed to the link metal fitting 17, are attached to the left door 11. The left slider 21 is slidable along a left door rail 23.

Further provided are hanging metal fittings 14*a* and 14*b* for hanging the right door 12, a right slider 22 fixed to the hanging metal fittings 14*a* and 14*b*, a link metal fitting 18 fixed to the right slider 22, and a right rack 20 operating as a linear transmission member fixed to the link metal fitting 18 attached to the right door 11. The right slider 22 is slidable along a right door rail 24.

Figure 3:
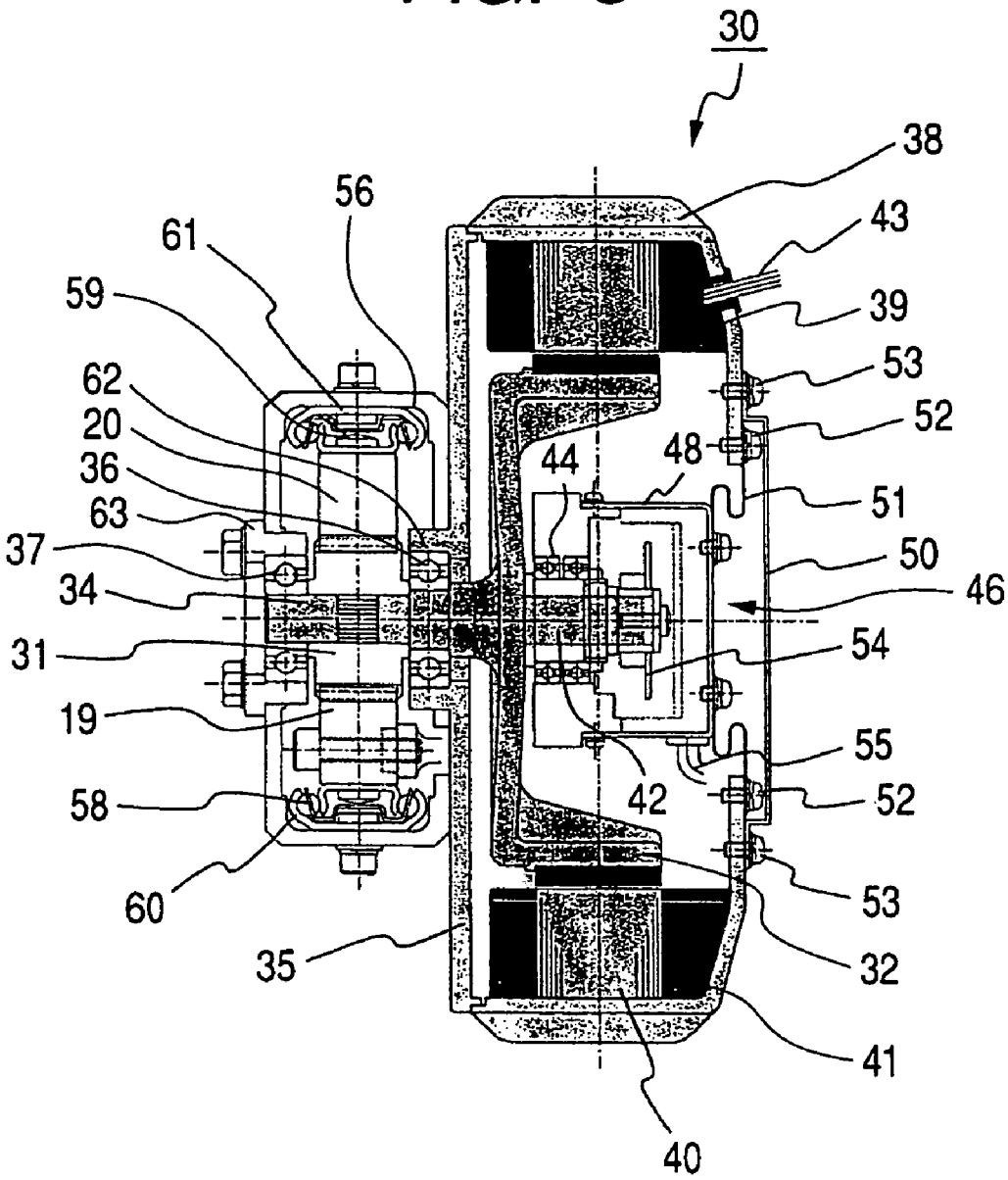
FIG. 3 is a sectional view taken along line 3-3 in FIG. 1.

The left rack 19 and the right rack 20 are in mesh with pinion 31, a rotary transmission member that is fixed to an output shaft 34 that projects from the motor 30 (see FIG. 3).

With the above configuration, the left door 11 and the right door 12 can slide smoothly along the left door rail 23 and the right door rail 24, respectively. Therefore, when the pinion 31 is rotated as a result of the motor 30 being driven, the left rack 19 and the right rack 20, which are in mesh with the pinion 31, are moved approximately parallel with the left door rail 23 and the right door rail 24.

FIG. 3 is a sectional view taken along line 3-3 in FIG. 1.

In this embodiment, the motor 30 is a flat motor, such as a permanent magnet synchronous motor, that is covered with a shield plate 35 and a motor frame 38 as a body frame. A stator core 40 wound with a stator coil 39 is fixed to the inner wall of the motor frame 38 by means of an insulative resin mold 41.

A rotor 32, shaped like a cylinder having a closed end, opposes the stator core 40 with a prescribed interval. A power supply line 43 is connected to the stator coil 39. The output shaft 34 is fixed integrally to the rotor 32 so as to project leftward (as viewed in FIG. 3) through the shield plate 35.

A holding case, i.e., rack/pinion case 56, is fixed integrally to the shield plate 35. The shield plate 35 and the rack/pinion case 56 are provided with bearing holding portions 62 and 63. The bearing holding portions 62 and 63 are provided with bearings 36 and 37 as first and second shaft bearing members, respectively, and the pinion 31 is disposed between the bearings 36 and 37.

The pinion 31 is interposed between the two bearings 36 and 37 and is fixed to the output shaft 34 by a proper fixing means. The left rack 19 and the right rack 20, which can move approximately parallel with each other in opposite directions, oppose each other via the pinion 31 so as to be in mesh with the pinion 31. A left rack slide rail 58 and a right rack slide rail 59 are attached to the left rack 19 and the right rack 20, respectively. The left rack slide rail 58 and the right rack slide rail 59 slide along a left guide rail 60 and a right guide rail 61 as guide members, while being guided by the latter.

In this embodiment, the left rack 19 and the right rack 20, and the left guide rail 60 and the right guide rail 61, are held by the rack/pinion case 56. To cover the range of movement of the left rack 19 and the right rack 20, the rack/pinion case 56 is a long and narrow member extending along the movement direction of the left rack 19 and the right rack 20.

On the other hand, an attachment shaft 42 that is approximately concentric with the output shaft 34, projects from the rotor 32 toward the side opposite the output shaft 34 projecting side (i.e., the attachment shaft 42 projects rightward in FIG. 3). A housing 48 of an encoder 46 is attached to the attachment shaft 42 via a bearing 44. The housing 48 is attached around its central opening to the portion of the motor frame 38 via a support metal fitting 51 with screws 52. An encoder cover 50 is attached to the motor frame 38 with screws 53 to cover the housing 48.

In this embodiment, the encoder 46 is a photoelectric rotary encoder with a rotary circular plate 54, formed with slits (not shown), and is fixed to the attachment shaft 42. A light-emitting element and a photo-detector (both not shown) are opposed to each other with the rotary circular plate 54 interposed in between. The number of rotations and a rotation direction and, if necessary, a rotation speed etc. of the attachment shaft 42 are detected as the rotary circular plate 54 interrupts light emitted from the light-emitting element. Reference numeral 55 denotes a power supply line and a signal line.

Next, the workings of the embodiment will be described.

Assume that a switch (not shown) is turned on in a state that the left door 11 and the right door 12 are closed as shown in FIGS. 1-3, whereby driving of the motor 30 is started and its rotor 32 starts rotating in a direction indicated by arrow A in FIG. 1. As a result, the left rack 19 which is in mesh with the pinion 31 is moved in a direction indicated by arrow B in FIG. 1, as a result the left door 11 is moved in the same direction (i.e., the direction indicated by arrow B) via the link metal fitting 17 (fixed to the left rack 19) and the hanging metal fittings 13*a* and 13*b*.

In this case, the left door 11 can move smoothly because the left slider 21 which is fixed to the link metal fitting 17 is moved in the same direction (i.e., the direction indicated by arrow B) while being guided by the left door rail 23.

At the same time, as the rotor 32 of the motor 30 is rotated in the direction indicated by arrow A, the right rack 20 which is in mesh with the pinion 31 is moved in a direction indicated by arrow C in FIG. 1. As a result the right door 12 is moved in the same direction (i.e., the direction indicated by arrow C) via the link metal fitting 18 (fixed to the right rack 20) and the hanging metal fittings 14*a* and 14*b*.

In this case, the right door 12 can move smoothly because the right slider 22 which is fixed to the link metal fitting 18 is moved in the same direction (i.e., the direction indicated by arrow C), while being guided by the right door rail 24.

The number of rotations and a rotation direction (and a rotation speed, if necessary) of output shaft 34 of the motor 30 are detected by the encoder 46, whereby positions and moving directions of the left door 11 and the right door 12 are detected. Therefore, the motor 30 can be controlled on the basis of output signals of the encoder 46.

According to this embodiment, since the rotary motor 30 is used as a drive source of the door driving apparatus 10, the area occupied by the driving section can be made smaller and a more compact design is enabled than in the case of using a linear motor. This makes it possible to install the door driving apparatus 10 easily in a narrow space.

In a conventional configuration in which the linear motor and the direction conversion device (i.e., pinion) are separated from each other, adjustment work is necessary in mounting the linear motor etc. In contrast, according to the embodiment, adjustment work can be simplified because the pinion 31 is fixed to the output shaft 34 that projects from the motor 30 and the left rack 19 and the right rack 20 are in mesh with the pinion 31. That is, the motor 30 and the direction conversion device are assembled as a unit.

Furthermore, because the bearings 36 and 37 that bear the output shaft 34 of the motor 30 are disposed on both sides in an axial direction of the pinion 31 fixed to the output shaft 34 of the motor 30, in dismantling the motor 30, the motor frame 38 can be detached from the shield plate 35 without the need for removing the bearings 36 and 37. This makes it possible to disassemble the stator core 40, etc., as well as to inspect the inside of the motor 30 and replace its components easily by removing the motor frame 38 even in a state that the motor 30 is kept mounted.

The door driving apparatus 10 according to this embodiment can be applied not only to automatic opening/closing doors of various vehicles, such as trains and automobiles, but also to automatic opening/closing doors of various kinds of buildings such as factories and apartment houses.

Second Embodiment

Figure 4:
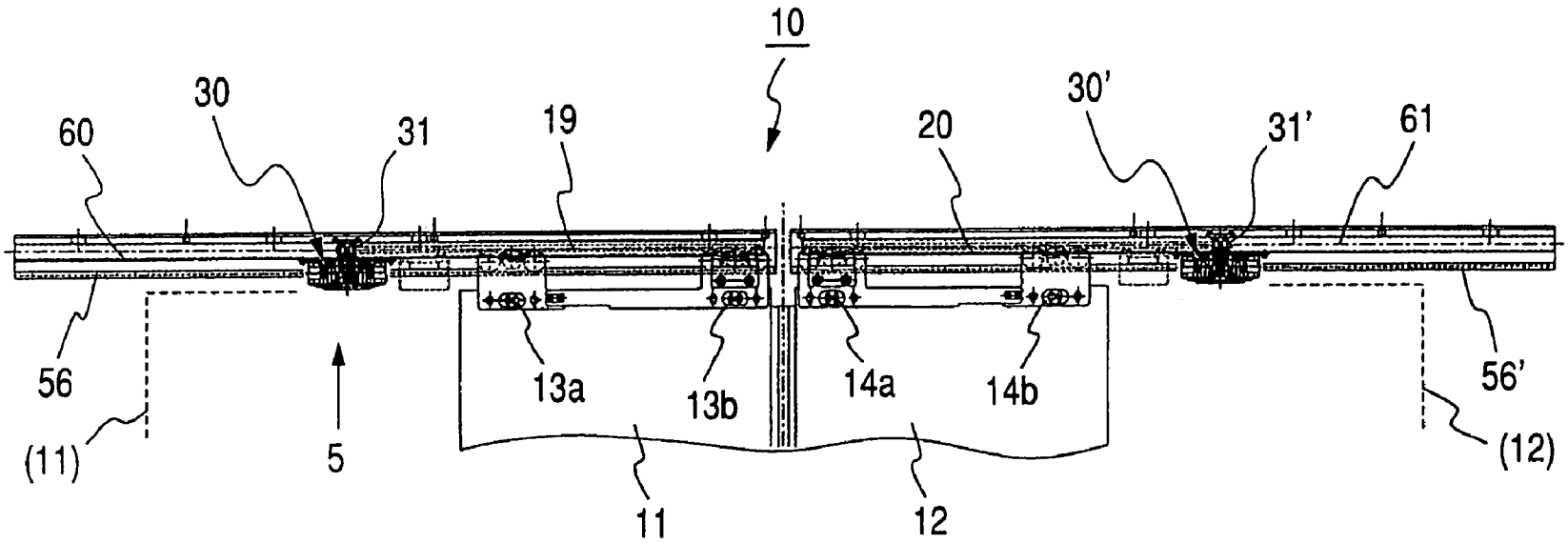
FIG. 4 is a front view of a door driving apparatus according to a second embodiment.
Figure 5:
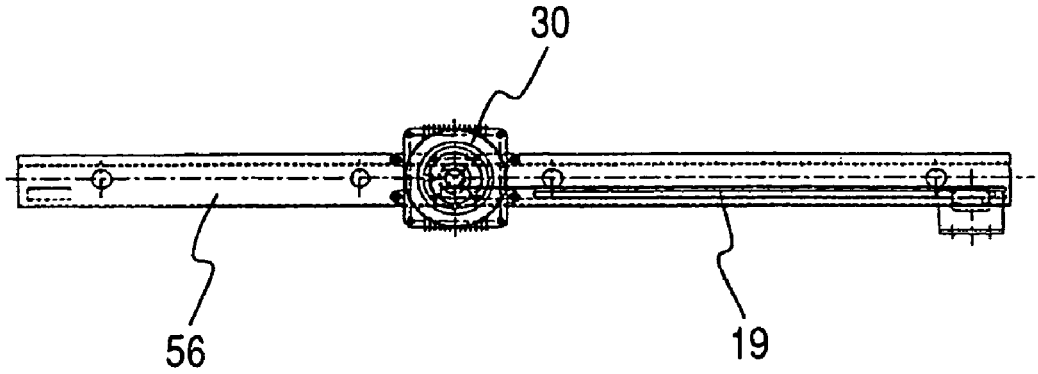
FIG. 5 is a view of the door driving apparatus according to the second embodiment as viewed from a direction indicated by arrow 5 in FIG. 4.

FIG. 4 is a front view of the entire door driving apparatus according to this embodiment. FIG. 5 is a view of the door driving apparatus as viewed from a direction indicated by arrow 5 in FIG. 4. Members having the same or corresponding members in the first embodiment are given the same reference symbols.

The door driving apparatus 10 according to this embodiment is configured in such a manner that a left door 11 and a right door 12 are opened and closed by using two motors 30 and 30', respectively.

As shown in FIGS. 4 and 5, pinions 31 and 31' are fixed to the output shafts of the left motor 30 and the right motor 30', respectively, and a left rack 19 and a right rack 20 are in mesh with the respective pinions 31 and 31'. The left rack 19 and the right rack 20 are moved along a left guide rail 60 and a right guide rail 61 that are attached to rack/pinion cases 56 and 56', respectively.

As in the case of the first embodiment, the left rack 19 and the left guide rail 60 are held by rack/pinion case 56, and the right rack 20 and the right guide rail 61 are by rack/pinion case 56'. The rack/pinion cases 56 and 56' are integrally fixed to respective motor frames.

When, for example, the left motor 30 is driven, the left rack 19 that is in mesh with the pinion 31 is moved and the left door 11 is opened or closed, being driven via hanging metal fittings 13*a* and 13*b* that are connected to the left rack 19. In this case, the left rack 19 is moved smoothly along the left guide rail 60 and hence the left door 11 is also moved smoothly.

Likewise, when the right motor 30' is driven, the right rack 20 which is in mesh with the pinion 31' is moved and the right door 12 is opened or closed being driven via the hanging metal fittings 14*a* and 14*b* that are connected to the right rack 20. Also in this case, the right rack 20 is moved smoothly along the right guide rail 61 and hence the right door 12 is also moved smoothly.

According to this embodiment, since the two motors 30 and 30' are provided, the door link structure is simplified and the left door 11 and the right door 12 can be opening/closing-controlled individually. Accordingly, if necessary, only one of the left door 11 and the right door 12 may be controlled while the other door kept closed.

Third Embodiment

Figure 6:
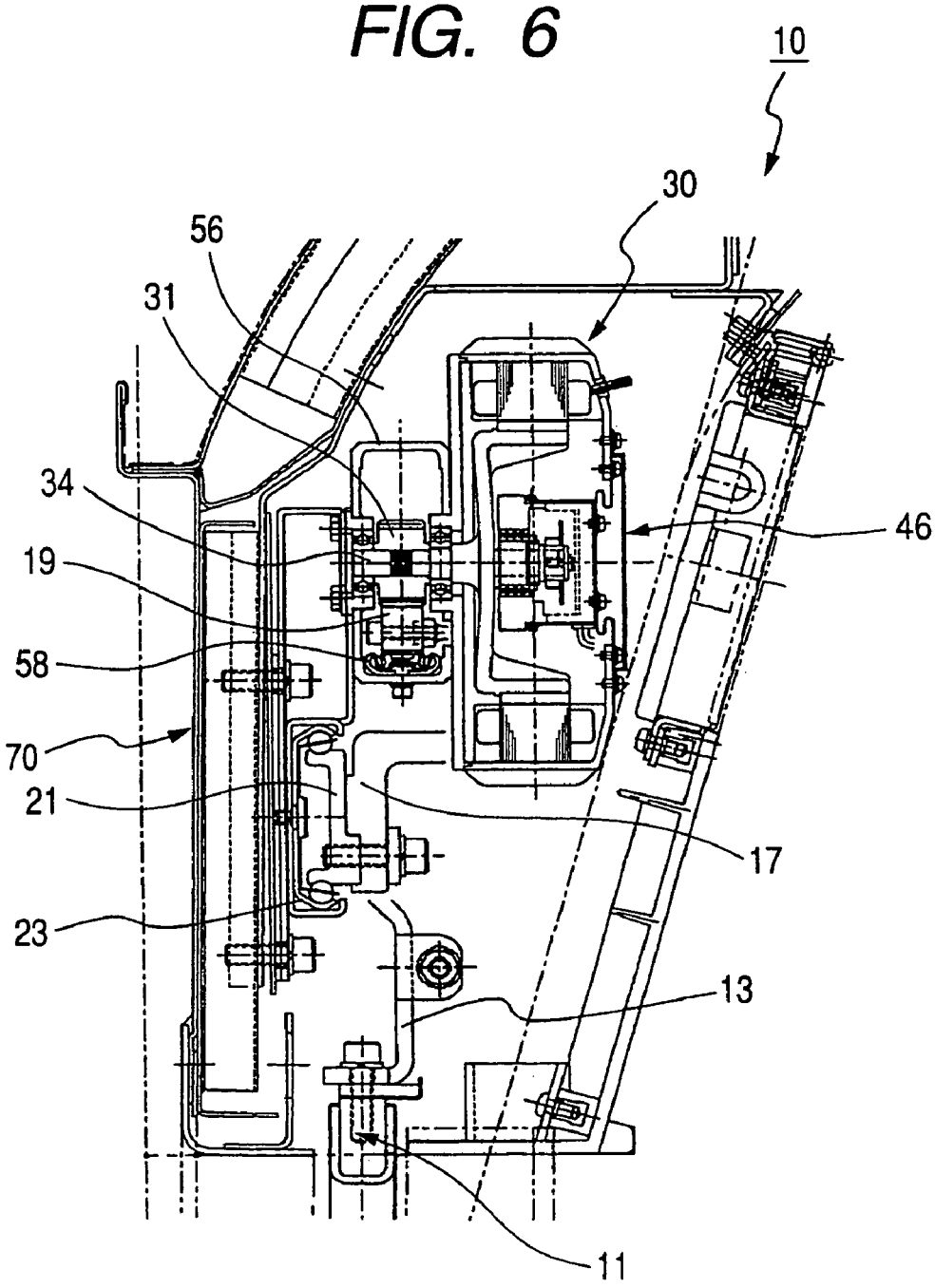
FIG. 6 is an explanatory side/sectional view of a door driving apparatus according to a third embodiment.

FIG. 6 is a side/sectional view of a door driving apparatus 10 according to this embodiment which is applied to a vehicle body. Members having the same or corresponding members as in previous embodiment are given the same reference symbols.

In this embodiment, a motor 30 is disposed in a space located above a door 11 of a vehicle body 70 so as to be oriented horizontally (i.e., its output shaft 34 extends in the horizontal direction), and the door 11 can be opened and closed by drive power of the motor 30.

Specifically, the door 11 is connected via a door hanging metal fitting 13 and a link metal fitting 17 to a rack 19 that is accommodated in a rack/pinion case 56. The rack 19 is in mesh with a pinion 31 that is fixed to the output shaft 34 of the motor 30 and can slide along a rack slide rail 58. An encoder 46 is attached to the output shaft 34 of the motor 30.

A slider 21 is fixed to the link metal fitting 17 and is slidably guided by a door rail 23. As in the case of the first embodiment, the rack 19 and a rack slide rail 58 are held by the rack/pinion case 56, and the rack/pinion cases 56 is integrally fixed to a motor frame. Although this embodiment is directed to the configuration for opening and closing the single door 11, the invention is not limited to such a case and the concept of the second embodiment is likewise applicable to a case of opening and closing a pair of doors.

With the above configuration, when driving of the motor 30 is started from, for example, a state that the door 11 is closed, the drive power is transmitted to the rack 19 via the pinion 31 that is fixed to the output shaft 34 and then transmitted to the door 11 from the rack 19 via the link metal fitting 17 and the door hanging metal fitting 13, whereby the door 11 is opened. A similar operation is performed when the door 11 is closed. In this case, the door 11 can be opened or closed smoothly because the slider 21 is guided by the door rail 23.

According to this embodiment, since the motor 30 is oriented horizontally, the door driving apparatus 10 can be mounted compactly in the case where a space which is relatively wide in the vertical direction rather than in the horizontal direction exists above the door 11 of the vehicle body 70.

Fourth Embodiment

Figure 7:
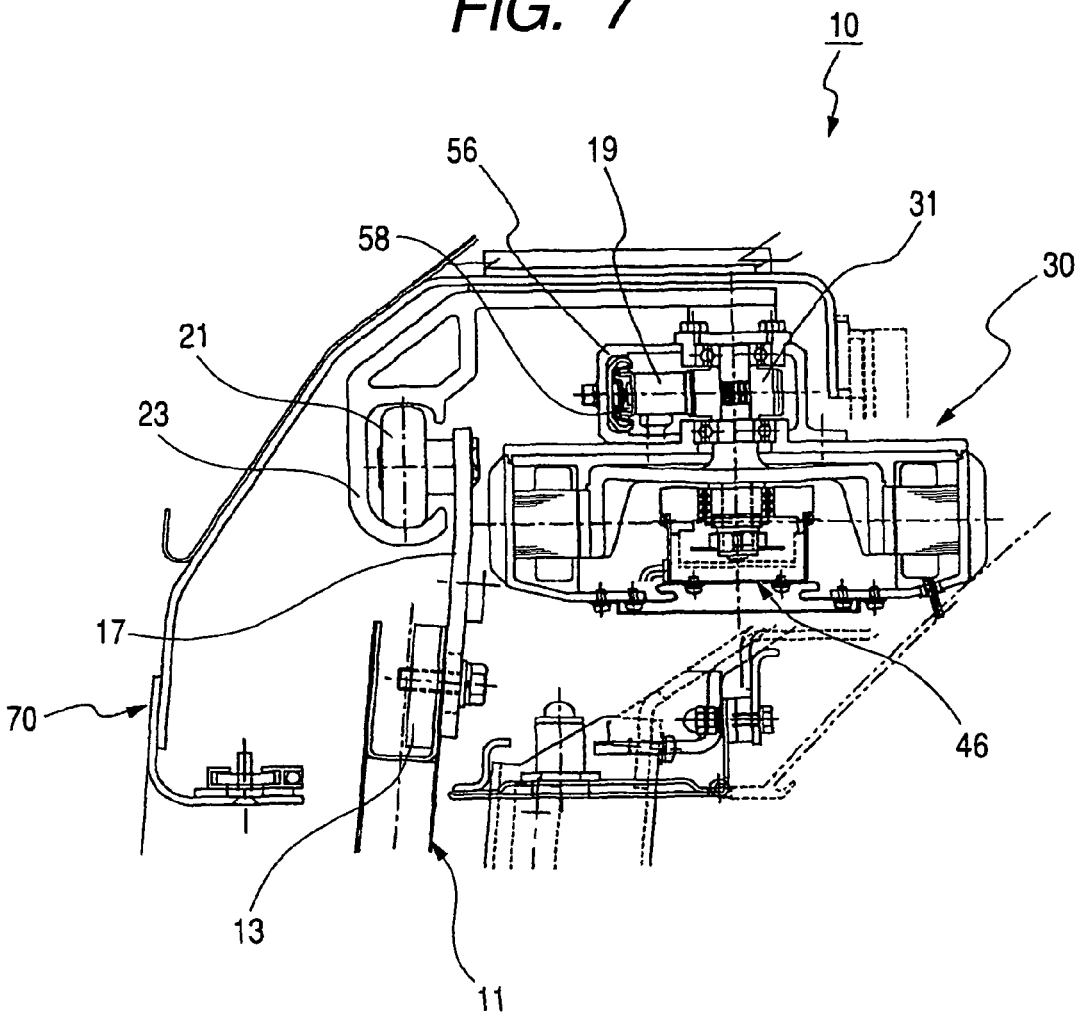
FIG. 7 is an explanatory side/sectional view of a door driving apparatus according to a fourth embodiment.
Figure 8:
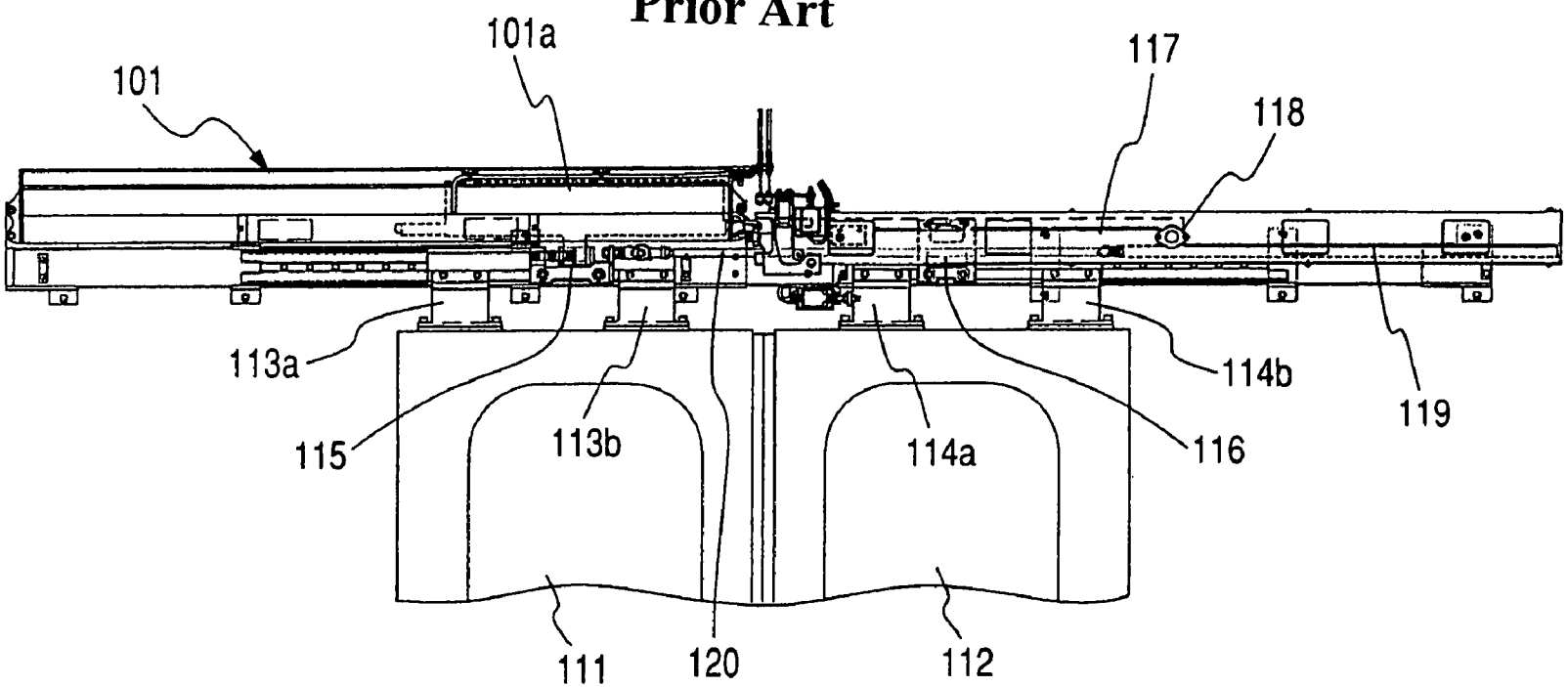
FIG. 8 Prior Art
FIG. 8 is a front view of a conventional door driving apparatus.
Figure 9:
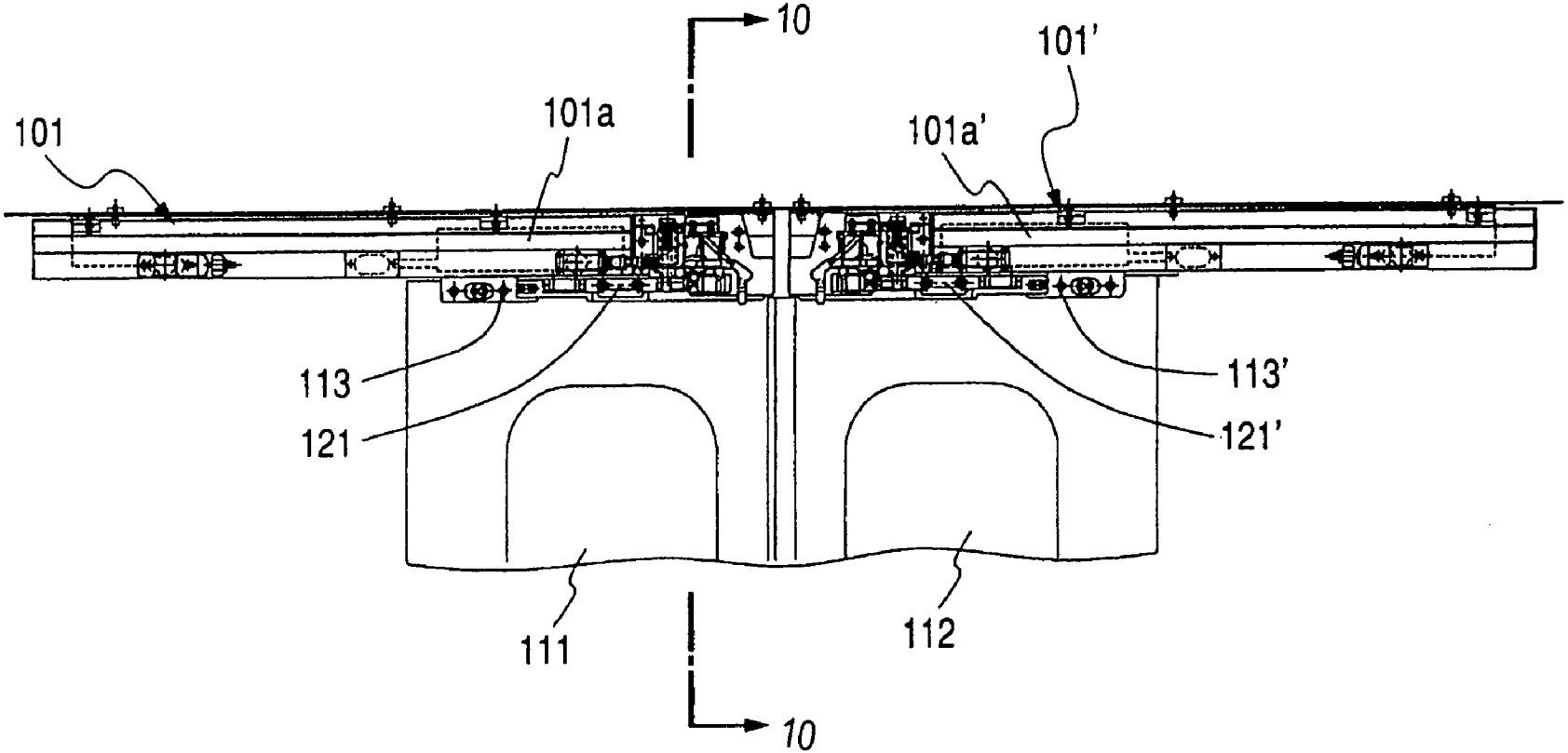
FIG. 9 Prior Art
FIG. 9 is front view of another conventional door driving apparatus.
Figure 10:
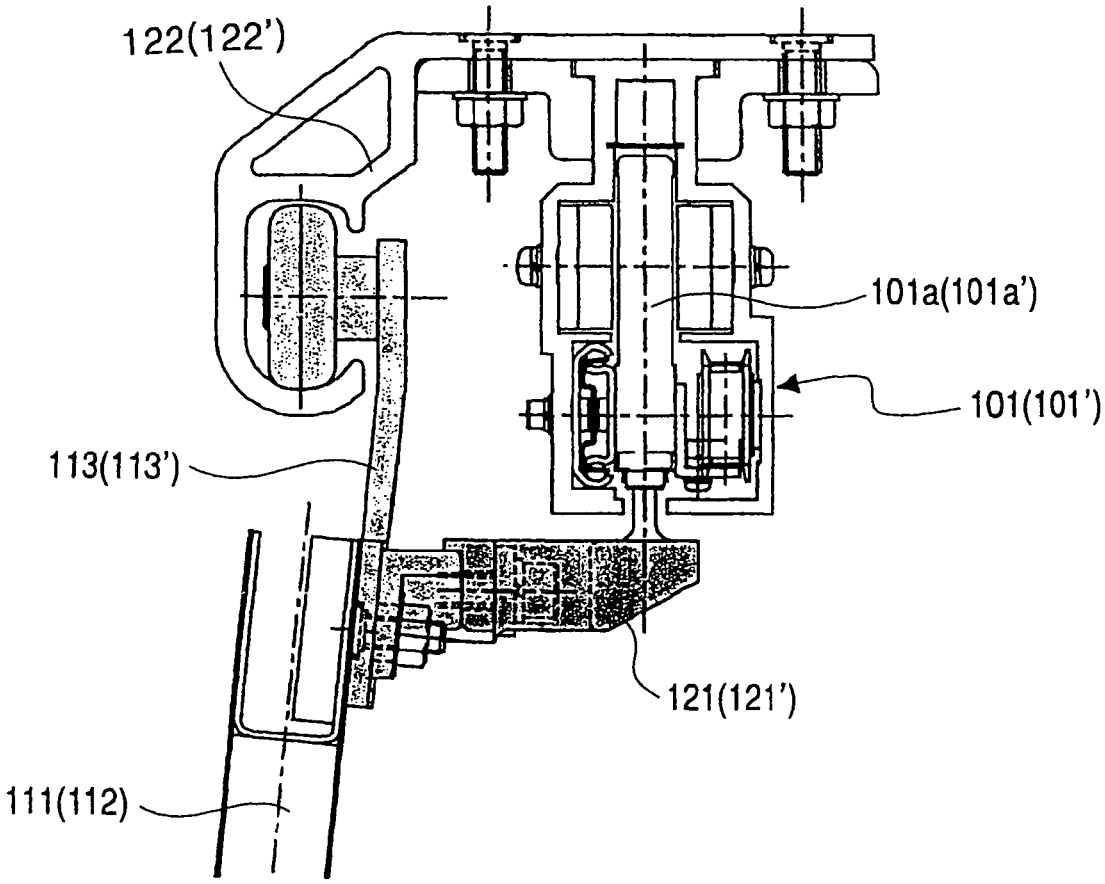
FIG. 10 Prior Art
FIG. 10 is a sectional view taken along line 10-10 in FIG. 9.

FIG. 7 is a side/sectional view of a door driving apparatus 10 according to this embodiment which is applied to a vehicle body. Members having the same or corresponding members as in previous embodiments will be given the same reference symbols.

In this embodiment, a motor 30 is disposed in a space located above a door 11 of a vehicle body 70 so as to be oriented vertically (i.e., its output shaft 34 extends in the vertical direction), and the door 11 can be opened and closed by drive power of the motor 30.

Specifically, the door 11 is connected, via a door hanging metal fitting 13 and a link metal fitting 17, to a rack 19 that is accommodated in a rack/pinion case 56. The rack 19 is in mesh with a pinion 31 that is fixed to the output shaft 34 of the motor 30 and can slide along a rack slide rail 58. An encoder 46 is attached to the output shaft 34 of the motor 30.

A slider 21 is fixed to the link metal fitting 17 and is guided slidably by a door rail 23. As in the case of the first embodiment, the rack 19 and a rack slide rail 58 are held by the rack/pinion case 56 and the rack/pinion cases 56 is fixed to a motor frame integrally. Although this embodiment is directed to the configuration for opening and closing the single door 11, the invention is not limited to such a case and the concept of the second embodiment is likewise applicable to a case of opening and closing a pair of doors.

With the above configuration, when driving of the motor 30 is started from, for example, a state that the door 11 is closed, the drive power is transmitted to the rack 19 via the pinion 31 that is fixed to the output shaft 34. The power is then transmitted to the door 11 from the rack 19 via the link metal fitting 17 and the door hanging metal fitting 13, whereby the door 11 is opened. A similar operation is performed when the door 11 is closed. In this case, the door 11 can be opened or closed smoothly because the slider 21 is guided by the door rail 23.

According to this embodiment, since the motor 30 is oriented vertically, the door driving apparatus 10 may be mounted compactly in the case where a space which is relatively wide in the horizontal direction rather than in the vertical direction exists above the door 11 of the vehicle body 70.

The disclosure of Japanese Patent Application No. 2006-124998 filed on Apr. 28, 2006 is incorporated as a reference. Also, the disclosure of Japanese Patent Application Publication No. 2000-142392 is incorporated herein as a reference.

While the invention has been explained with reference to the specific embodiments of the invention, the explanation is illustrative and the invention is limited only by the appended claims.

What is claimed is:

1. A movable body driving apparatus comprising:

a rotary actuator comprising:

a cylindrical rotor having a closed end and an output shaft extending outwardly from an external surface of the closed end;

a support shaft extending from an interior surface of the closed end into an interior of the rotor, the support shaft being coaxial with the output shaft;

an encoder enclosed within the cylindrical rotor for detecting rotary actuator rotation, the encoder being mounted on the support shaft within the interior of the cylindrical rotor;

a motor frame enclosing the cylindrical rotor and the encoder; and a stator core and a stator coil supported by the motor frame in a predetermined juxtaposition with respect a circumferential outer surface of the cylindrical rotor;

first and second bearings rotationally supporting the output shaft, the first and second bearings being disposed outside the motor frame, one of the first and second bearings being supported on an exterior surface of the motor frame;

a pinion gear attached onto the output shaft between the first and second bearings;

a pair of linear transmission members opposed to each other and arranged to be in mesh with the pinion gear to move approximately parallel to each other in opposite directions, a door rail arranged under the pair of linear transmission members, a pair of sliders slidably disposed on the door rail and fixed to the linear transmission members to move according to movements of the linear transmission members, and a pair of horizontally opening doors each connected with one of the sliders so that the doors are simultaneously moved in opposite lateral directions upon rotation of the pinion gear.

2. The movable body driving apparatus according to claim 1, further comprising guide members configured to guide the pair of linear transmission members.

3. The movable body driving apparatus according to claim 2, further comprising a holding case configured to hold the pair of linear transmission members and the guide members, the holding case being integrally fixed to the motor frame of the rotary actuator to extend horizontally and supporting the other of the first and second bearings.

4. The movable body driving apparatus according to claim 3, wherein the rotary actuator is arranged in a middle of the holding case in a lateral direction so that when the rotary actuator is rotated, the linear transmission members move back and forth relative to the middle of the holding case.

5. The movable body driving apparatus according to claim 1, wherein the encoder is configured to detect at least a number of rotations and a rotation direction of the output shaft.

6. The movable body driving apparatus according to claim 1, wherein the encoder comprises a photoelectric rotary encoder with a rotary circular plate formed with slits, the rotary circular plate being fixed to the extension shaft.

* * * * *